United States Patent [19]

Burton et al.

[11] Patent Number: 4,492,342

[45] Date of Patent: Jan. 8, 1985

[54] CENTRIFUGAL DRUM FOR METALLURGICAL SLAG

[76] Inventors: Clement Burton, 42, rue Mathias Koener, Esch sur Alzette; Andre Kremer, 15, bld. Pierre Dupong, Luxembourg; Hubert Stomp, 11, rue Speyer, Howald; Marc Solvi, 56, rue des 3 Cantonst, Ehlange s/Mess, all of Luxembourg

[21] Appl. No.: 326,922

[22] Filed: Dec. 2, 1981

[30] Foreign Application Priority Data

Dec. 12, 1980 [LU] Luxembourg ..... 83000

[51] Int. Cl.[3] ..... B02C 13/06; B02C 13/26

[52] U.S. Cl. ..... 241/67; 241/185 R; 241/191

[58] Field of Search ..... 241/66, 67, 185 R, 191

[56] References Cited

U.S. PATENT DOCUMENTS

| | | | |
|---|---|---|---|
| 2,792,042 | 5/1957 | Dwyer et al. | 241/66 X |
| 3,843,064 | 10/1974 | Suzuki | 241/67 |
| 3,993,254 | 11/1976 | Bicik et al. | 241/67 |

FOREIGN PATENT DOCUMENTS

| | | |
|---|---|---|
| 35751 | 2/1906 | Fed. Rep. of Germany . |
| 229560 | 3/1910 | Fed. Rep. of Germany . |
| 257089 | 7/1910 | Fed. Rep. of Germany . |
| 1927196 | 5/1969 | Fed. Rep. of Germany . |
| 2554087 | 4/1977 | Fed. Rep. of Germany . |
| 337222 | 6/1977 | Fed. Rep. of Germany . |
| 2406377 | 1/1978 | France . |

*Primary Examiner*—Mark Rosenbaum
*Assistant Examiner*—Timothy V. Eley
*Attorney, Agent, or Firm*—Fishman & Dionne

[57] ABSTRACT

A rotatable drum, which bears beater bars and is intended for use in pulverizing metallurgical slag, is defined by abutting conduits which are welded to one another and to a tubular support. The arrays of conduits, through which a coolant is circulated, is interrupted at a number of locations spaced radially about the support where radially outwardly extending beater bars are welded to the same support. The beater bars are also provided with internal passages through which the coolant is circulated.

15 Claims, 3 Drawing Figures

CENTRIFUGAL DRUM FOR METALLURGICAL SLAG

BACKGROUND OF THE INVENTION (1) Field of the Invention

The present invention relates to the treatment of metallurgical slag and particularly to the fracturing of expanded slag by mechanical beating. More specifically, this invention is directed to beater apparatus which granulates blast furnace slag which has been expanded by treatment with water. Accordingly, the general objects of the present invention are to provide novel and improved methods and apparatus of such character.

(2) Description of the Prior Art

U.S. Pat. No. 4,115,089 discloses a process of treating liquid blast furnace slag to produce a granulated product. In the patented process a flow of metallurgical slag is first treated with water to cause the expansion thereof and the expanded slag, which is still very hot, is subjected to a mechanical beating step to cause it to be broken into particulate form. The mechanical beating is performed by a rotating disintegration drum, indicated at 9 in the referenced patent, which is provided with outwardly extending beater bars. In the process, the expanded slag falls onto the disintegration drum, is broken up by the beater bars and subsequently ejected in a curved trajectory.

The apparatus of U.S. Pat. No. 4,115,089 may be used in the production of expanded slag, which is also known in the art as pumice slag, and also in the production of slag sand such as that which would be formed by means of a conventional granulating technique. The granulation of blast furnace slag is described in Luxembourg Pat. No. 77,160, dated Apr. 19, 1977, and its corresponding U.S. application Ser. No. 897,424. The production of slag sand is achieved by exercising control over the operating parameters of the apparatus and particularly the rotational speed of the disintegration drum and the quantity of water added to the molten slag. Thus, as drum speed is increased and also as the quantity of water added during the swelling or foaming phase of the process is increased, the ratio of the slag sand to pumice produced by the apparatus also increases.

The process briefly described above may be contrasted with the use of granulating pits as is also known in the prior art. A particularly important distinction between the use of a rotating disintegration drum to cause the break-up of the foamed slag, when compared to the use of a granulating pit, resides in the fact that the rotating drum technique offers a savings of up to 90% in water consumption. Accordingly, through the use of mechanical beating of the foamed slag, the apparatus required to separate the water from the slag sand or pumice slag, as well as the drying apparatus, will be less expensive to assemble and operate and thus more economical.

Experience has shown that the disintegration drums of apparatus of the types disclosed in referenced U.S. Pat. No. 4,115,089 have a comparatively limited service life. More particularly, these drums are subject to failure at the point of attachment of the beater bars thereto. While the drums themselves are water cooled, and the beater bars themselves may also be provided with passages through which a coolant is circulated, it has not previously been possible to achieve adequate cooling to insure that failure of the welds by which the beater bars are attached to the drum will not occur. Thus, the service life of disintegration drums has, in the prior art, averaged approximately 10,000 tons of slag.

It is also to be noted that, in interest of insuring adequate coolant circulation, it has been the practice in the prior art to discharge the coolant, which is typically water, through apertures in the disintegration drum whereby the coolant will be propelled from the vicinity of the drum along with the slag. This technique, however, results in the addition of the cooling water to that with which the slag has been treated to cause the foaming thereof and thus the total quantity of water which leaves the apparatus will be greater than necessary and/or the ability to exercise proper control over the process of preparation of the foamed slag is diminished.

SUMMARY OF THE INVENTION

The present invention overcomes the above-briefly discussed and other deficiencies and disadvantages of the prior art by providing a novel disintegration drum for use in the treatment of metallurgical slag. A disintegration drum in accordance with the present invention is characterized by increased service life resulting from the ability to intensively cool the drum itself and the beater bars.

A disintegration drum in accordance with the present invention consists of an outer layer or ring of conduits. The conduits are preferably arranged with their axes generally parallel with the axis of rotation of the drum. The conduits are positioned in abutting relationship except in the region of the root portions of the beater bars. A coolant is delivered to these conduits via a distribution chamber and the coolant is discharged from these conduits into a common collector chamber.

A disintegration drum in accordance with the present invention is also characterized by a plurality of beater bars which extend radially outwardly from the periphery of the drum. The beater bars are located in spaces between groups of the abutting conduits and are welded to the adjacent conduits. The beater bars are also provided with channels through which the coolant will circulate.

In accordance with a preferred embodiment, the conduits and beater bars are attached to an inner support ring and communication between the distribution and collection chambers and the conduits and beater bar channels is achieved through the use of apertured plates attached to the support ring at the opposite ends thereof.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figure 1:
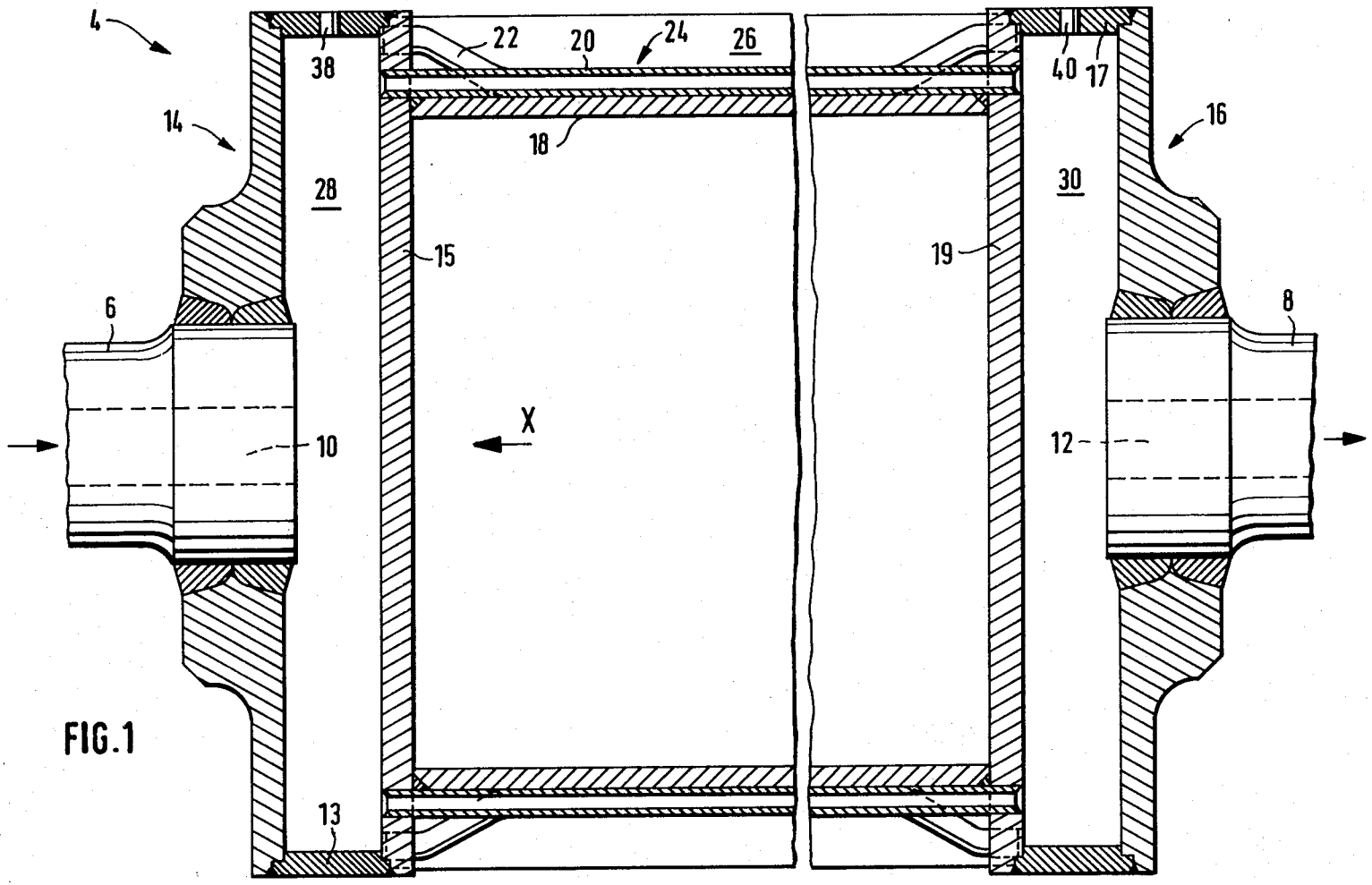
FIG. 1 is a cross-sectional front elevation view of a disintegration drum in accordance with a preferred embodiment of the invention.

Referring simultaneously to all three FIGURES, a disintegration drum in accordance with a preferred embodiment of the present invention is indicated generally at 4. Drum 4 is comprised of a pair of oppositely disposed end flanges 14 and 16 which are respectively mounted on hubs 6 and 8. In the disclosed embodiment the hubs 6 and 8 are respectively provided with a coolant supply passage 10 and a coolant discharge passage 12. The hubs 6 and 8 are coaxial and define the axis of rotation of drum 4.

The outer flanges 14 and 16 are of circular shape and are respectively connected, by annular members 13 and 17, to inwardly disposed distribution plates 15 and 19. The distribution plates 15 and 19 are generally of circular shape. The outer flange 14, member 13 and distribution plate 15 cooperate to define a distribution chamber 28 into which the coolant supplied via passage 10 will flow. Similarly, the outer flange 16, member 17 and plate 19 cooperate to define a collector chamber 30 which is in communication with the discharge passage 12. The plates 15 and 19 are both connected, for example by welding, to opposite ends of a ring-shaped member 18 which defines the inner support of the drum 4.

The outer casing of drum 4 is defined by a conduit structure 24 composed of a plurality of conduits 24 which extend between distribution chamber 28 and collector chamber 30. The conduits 20, 22 are welded together in the longitudinal direction and, at their opposite ends, are affixed to the plates 15 and 19.

A plurality of radially outwardly extending beater bars 26 are provided on the periphery of drum 4. The beater bars may, as shown, be in the form of rectangular members which are provided with internal coolant flow channels 32. These rectangular beater bars are welded, as indicated at 36, to the support ring 18. As an alternative, the beater bars may be defined by a plurality of individual conduits which have been vertically stacked and welded together. As in the case of the conduits 20, 22, the beater bars are affixed at their opposite ends to the plates 15 and 19.

Figure 3:
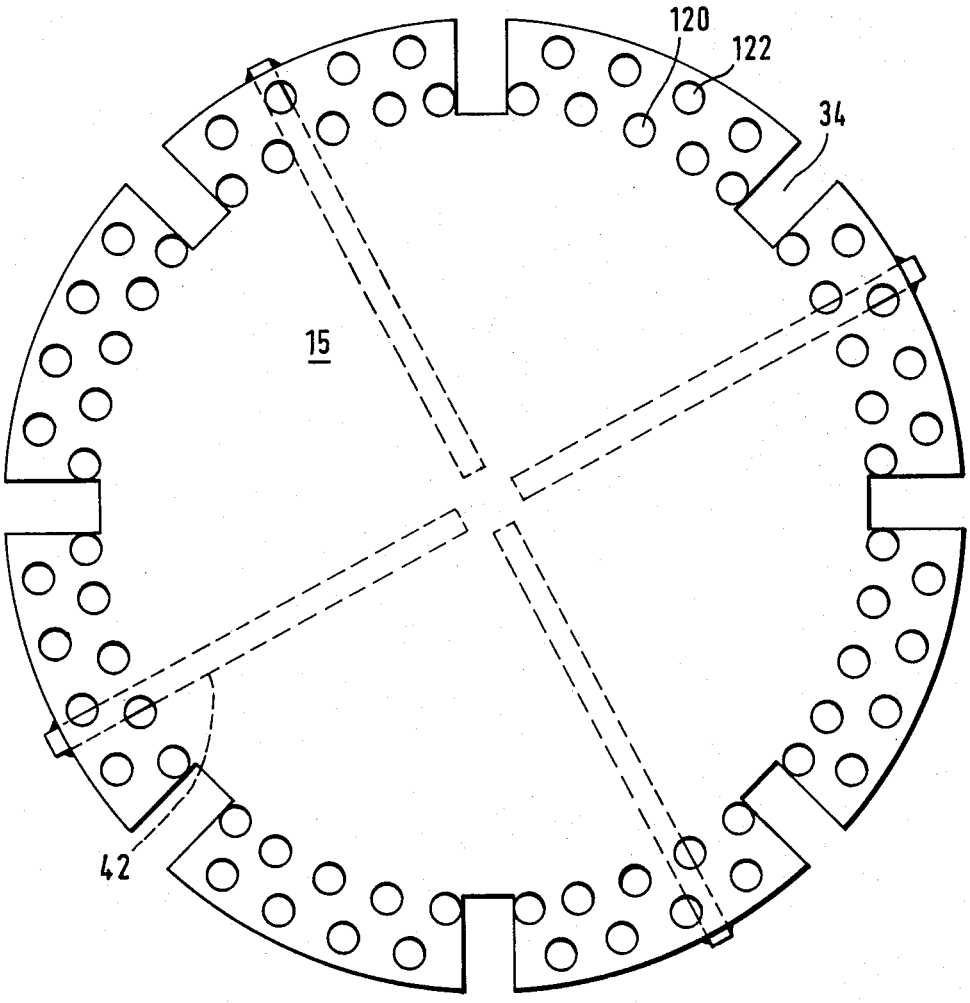
FIG. 3 is a plan view, taken in the direction of the arrow X on FIG. 1, of the distribution plate of the apparatus of FIGS. 1 and 2.

Referring to FIG. 3, which depicts the distributor plate 15, both of plates 15 and 19 are provided with apertures 120, 122 which receive the ends of the conduits 20, 22. The plates 15 and 19 are also provided with slots 34 which receive the ends of the beater bars 26. The apertures which receive the conduits 20, 22 are preferably offset in the radial direction thus avoiding the necessity of providing an annular opening in the plates. Accordingly, as may be seen in FIG. 1, every second conduit 22 is provided with a bend at each end whereby the conduit will extend upwardly and partly over the end of an adjacent conduit 20.

Figure 2:
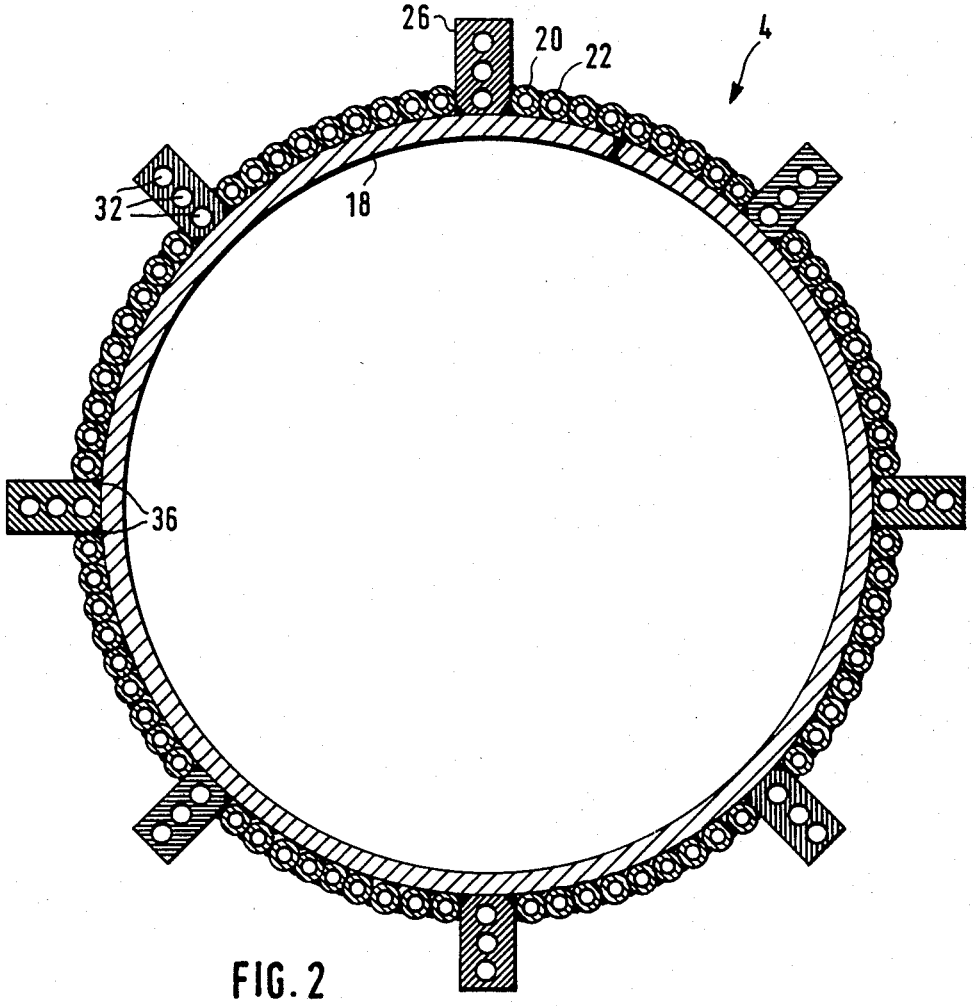
FIG. 2 is a cross-sectional side elevation view of the drum of FIG. 1.

FIG. 2 clearly depicts the welding of the conduits 20 and 22 to one another and to the support ring 18. FIG. 2 also shows the welding of the beater bars to the conduits on either side thereof and to ring 18. The welds which are subjected to the greatest stress, and which are thus most susceptible to breakage, are those indicated at 36 between the beater bars 26 and ring 18. In accordance with the present invention, however, these are the welds which are the most intensively cooled.

In the interest of insuring that there will be no stagnation of the water or other liquid coolant in the distribution chamber 28, which could result in a failure to have substantially equal flow through all of the conduits 20, 22 and the passages 32, the chamber 28 is preferably provided with a number of vanes 42 which have been shown in phantom in FIG. 3. The vanes 42 cause the coolant which enters chamber 28 to immediately begin to move at the speed of rotation of the drum. In a preferred embodiment the vanes 42 will extend between the plate 15 and flange 14 and similar vanes may be employed in the collector chamber 30.

It is also to be noted that, rather than discharging the coolant through hub 8 via passage 12, it is possible to provide hub 6 with coaxial passages and route the coolant from chamber 30 through the interior of the drum to a discharge passage in hub 6.

Returning again to a consideration of FIG. 1, access to chambers 28 and 30 is provided through respective annular members 13 and 17 by means of the removal of respective vent plugs 38 and 40. The provision of the vent plugs 38 and 40 insures that, upon start up of the apparatus, all air may be bled from the chambers 28 and 30 and thus there will be no air inclusions which might impede the required coolant circulation. The vent plugs 38 and 40 may also, if necessary, function as drain plugs.

The drum of the present invention is, as will be obvious from the above discussion, designed to insure that the portions thereof which are subjected to the greatest mechanical stress will be intensively cooled. This result is obtained by causing the entire through-put of cooling water to be directed along the periphery of the drum. Also, the drum construction of the present invention eliminates the possibility of the occurrance of air cushions and insures that the coolant flow is evenly distributed over the periphery of the drum.

A further advantage of the present invention resides in the fact that the cooling water is not added to the effluent from the process and thus does not adversely effect the slag preparation. Accordingly, the cooling of the slag may be achieved with an air flow.

While a preferred embodiment has been shown and described, various modifications and substitutions may be made thereto without departing from the spirit and scope of the invention. Accordingly, it is to be understood that the present invention has been described by way of illustrations and not limitation.

What is claimed is:

1. Apparatus for breaking a stream of inflowing coagulated material into discrete particles comprising:

a plurality of groups of conduits, the conduits of each group being in abutting relationship and defining a portion of the outer surface of a cylinder, said cylinder having a length in the axial direction;

each of said conduits substantially extending said length of said cylinder in said axial direction beater bar means positioned between each of said groups of conduits, said beater bar means including portions which extend outwardly with respect to the surface of said cylinder, opposite side surfaces of each of said beater bar means being in abutting relationship with an outermost conduit of respective adjacent conduit groups, rotation of the cylinder defined by said conduits about its axis causing said beater bar means to impact upon and fracture material which is caused to come in contact therewith;

means for delivering a coolant to first ends of said conduits, said coolant delivering means including a common distribution chamber; and coolant collection means, said collection means being in fluid communication with the second end of each of said conduits and including a common collection chamber.

2. The apparatus of claim 1 further comprising:

ring means, said ring means being positioned radially inwardly with respect to said conduits and being in supporting contact with said conduits.

3. The apparatus of claim 2 wherein said conduits are welded to each other and to said ring means.

4. The apparatus of claims 1 or 2 wherein said beater bar means include longitudinal coolant flow passages, the opposite ends of said coolant flow passages being respectively in fluid communication with said distribution and collection chambers.

5. The apparatus of claims 1 or 2 further comprising:

vane means positioned in said distribution chamber, said vane means imparting a change in the direction of flow to coolant delivered to said distribution chamber.

6. The apparatus of claims 1 or 2 wherein the ends of at least some of said conduits are displaced in the radial and circumferential directions with respect to the ends of adjacent conduits.

7. The apparatus of claim 1 wherein said distribution and collection chamber defining means each comprise a distributor plate, communication between the respective chambers and said conduits being via apertures in said plates.

8. The apparatus of claim 7 wherein said plates are provided with recesses which receive the opposite ends of said beater bar means.

9. The apparatus of claim 8 further comprising:

vent means, said vent means permitting the bleeding of air from said distribution and collection chambers.

10. The apparatus of claim 8 further comprising: ring means, said ring means being positioned radially inwardly with respect to said conduits and being in supporting contact with said conduits.

11. The apparatus of claim 10 wherein said conduits are welded to each other and to said ring means and wherein said ring means is affixed to said plates.

12. The apparatus of claim 11 wherein said beater bar means include longitudinal coolant flow passages, the opposite ends of said coolant flow passages being respectively in fluid communication with said distribution and collection chambers.

13. The apparatus of claim 12 further comprising:

vane means positioned in said distribution chamber, said vane means imparting a change in the direction of flow to coolant delivered to said distribution chamber.

14. The apparatus of claim 13 wherein the ends of at least some of said conduits are displaced in the radial and circumferential directions with respect to the ends of adjacent conduits.

15. The apparatus of claim 14 further comprising:

vent means, said vent means permitting the bleeding of air from said distribution and collection chambers.

* * * * *